United States Patent [19]

Nelissen

[11] Patent Number: 4,615,685

[45] Date of Patent: Oct. 7, 1986

[54] TWIRLING HOOP WITH EXTENSIBLE TETHER

[76] Inventor: Koenraad Nelissen, Pieter Reypenslei 17, 2510 Mortsel, Belgium

[21] Appl. No.: 645,219

[22] Filed: Aug. 29, 1984

[30] Foreign Application Priority Data

Sep. 9, 1983 [BE] Belgium ..... 2/60199

[51] Int. Cl.[4] ..... A63H 1/06

[52] U.S. Cl. ..... 446/247; 446/265; 272/128; 272/142

[58] Field of Search ..... 446/236, 242, 243, 245, 446/247, 265, 266; 273/414; 272/75, 142, 128

[56] References Cited

U.S. PATENT DOCUMENTS

| | | | |
|---|---|---|---|
| 2,826,861 | 3/1958 | Hoffstadt | 446/247 |
| 2,928,206 | 3/1960 | Kuhn | 446/247 |
| 3,425,690 | 2/1969 | Charbonnet | 272/128 |
| 3,461,603 | 8/1969 | Rowell | 446/247 X |
| 3,843,136 | 10/1974 | Bandy | 273/414 |
| 4,037,356 | 7/1977 | Chanttand | 446/247 |
| 4,145,046 | 3/1979 | Jones | 273/414 |
| 4,268,031 | 5/1981 | Schomburg | 446/266 |

*Primary Examiner*—F. Barry Shay

*Attorney, Agent, or Firm*—Laubscher & Laubscher

[57] ABSTRACT

There is described a game, particularly a game of skill, which comprises a hoop, an extensible element secured in a point thereof, and a handle at the end of said extensible element, said extensible element further having such a length and elastic properties as to have when it is not under tension, a length which corresponds to about one-third the hoop diameter, while as it is being used, that is when it is tensioned, the length thereof reaches two-thirds the hoop diameter.

3 Claims, 6 Drawing Figures

TWIRLING HOOP WITH EXTENSIBLE TETHER

BACKGROUND OF THE INVENTION

This invention relates to a game, particularly a game of skill.

The invention has for object to provide a game which is to be thought of both as a game of skill and as entertainment to be used mainly outdoors.

SUMMARY OF THE INVENTION

For this purpose according to the invention, the game according to the invention comprises a hoop and an extensible element secured to a point thereof, the extensible element having such length and resilient properties that when it is not under tension, the length thereof corresponds approximately to one-third the hoop diameter, and while the element is being used, that is as it is tensioned, the length thereof reaches about two-thirds the hoop diameter.

In a preferred embodiment of the invention, the extensible element is an elastic band.

In a possible variation, said extensible element is a rope which is extended with a draw-spring.

BRIEF DESCRIPTION OF THE FIGURES

Other details and features of the invention will stand out from the following description, given by way of a non-limitative example and with reference to the accompanying drawings, in which.

DETAILED DESCRIPTION

Figure 1:
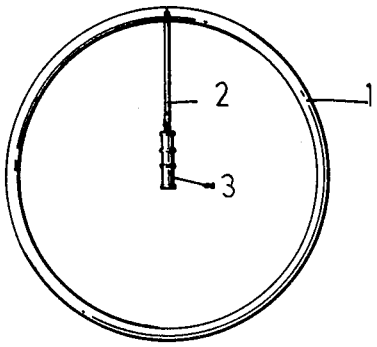
FIG. 1 shows the game according to the invention.

The game as shown in the Figures and more particularly in FIG. 1, is comprised of a hoop 1 to a point of which is secured an extensible element 2, which is provided at the free end thereof with a handle 3.

The extensible element 2 is preferably simply comprised of an elastic band as shown in FIG. 1. The extensible element might also be comprised of a rope, that is an unextensible element, which is extended with a draw-spring.

The loop 1 may be comprised of a metal or plastic tube.

The hoop 1 preferably has a diameter about 50 cm, which corresponds to an optimum size, as a larger diameter would require more handiness, while a smaller diameter would make the game less attractive.

To a diameter of 50 cm corresponds an ideal weight from 150 to 200 gr.

As already stated above, the hoop is preferably comprised of a hollow tube. The hoop might however be solid or shaped as a flat ring. Besides plastic and aluminum as already mentioned, wood might also be considered.

The extensible element 2 which is preferably comprised of an elastic band, has such elastic properties as to have when the game is not being used, a length which corresponds to about one-third the hoop diameter. When a pull is exerted on the elastic element 2, the element has a length which corresponds to about two-thirds the diameter of hoop 1. This may be noticed in FIGS. 2, 4, 5 and 6 for example.

To avoid the extensible element or elastic band 2 undergoing too high a twisting, the junction between the elastic band 2 and handle 3 may be obtained through a swivel-hook or some similar anti-twist device.

When the hoop 1 is hollow, openings may be provided in the wall thereof, which allows generating a sound as the hoop is revolved about the axis thereof.

Figure 2:
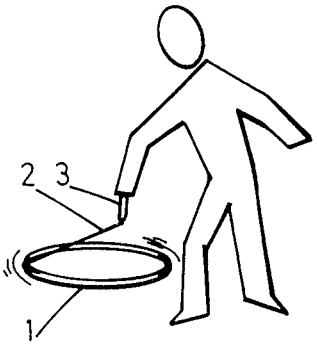
FIGS. 2 to 6 show on another scale, various possibilities for handling the hoop comprising the game according to the invention.
Figure 3:
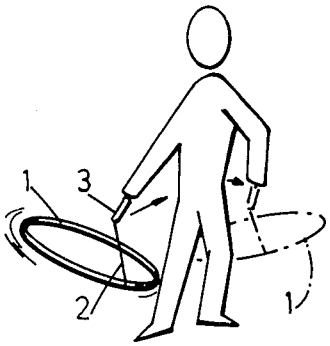
Figure 4:
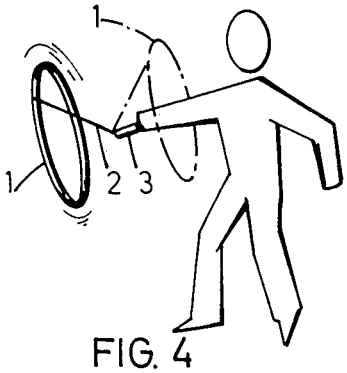

The game is played by revolving the hoop 1 after taking hold of the handle 3 and imparting thereto a rotation, which rotation finally occurs substantially about the geometrical axis of the hoop. The hoop then begins revolving as shown in FIG. 2 and it is possible to switch the hoop, actually the handle 3, from the left hand to the right hand, as shown in FIG. 3. It is also possible and this comprises an object of the game of skill according to the invention, to move the hoop 1 from a position in a horizontal or a substantially horizontal plane, to a position in a vertical or a substantially vertical plane as shown in FIG. 4. The hoop may actually be moved in the most varied positions, depending on the player skill.

Figure 5:
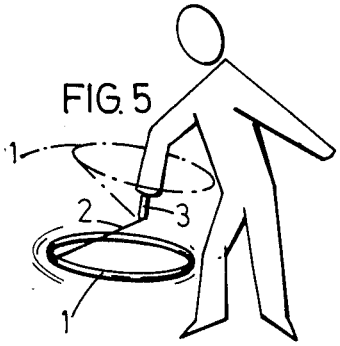
Figure 6:
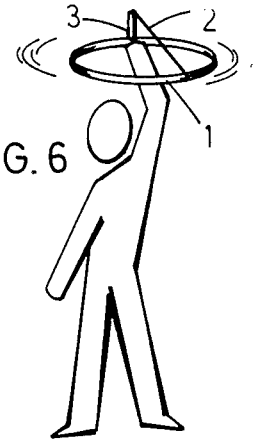

FIGS. 5 and 6 pertain to an attractive feature of the game according to the invention. As the hoop 1 is connected to handle 3 by an elastic element 2, it is possible while the hoop revolves about the geometrical axis thereof, to bring the hoop in different planes. Such an operation is shown more particularly in FIGS. 4 and 5.

It is also possible to retain the hoop in a stable or substantially stable plane and to pass the fore-arm through along the geometrical axis of said hoop. This is shown in FIG. 6.

It must be understood that the invention is in no way limited to the above embodiments and that many changes may be brought thereto without departing from the scope of the invention as defined by the appended claims.

I claim:

1. A game of skill, consisting of (a) a rigid circular hoop having a fixed diameter;

(b) a single elongated extensible element connected at one end with said hoop, said element having a normal length of about one-third the length of said hoop diameter and extending under tension to an extended length of about two-thirds the length of said hoop diameter; and (c) a handle connected with the free end of said elongated extensible element, said extensible element and said hoop being so structurally related that when an operator twirls said handle to rotate said hoop, said element extends from its normal length to its extended length owing to the tension exerted thereon by said rotating hoop, and said rotating hoop may be transferred between horizontal and vertical planes of rotation.

2. A game as defined in claim 1, wherein said extensible element comprises an elastic band.

3. A game as defined in claim 1, wherein said hoop is hollow and contains a plurality of openings, thereby to generate sound as said hoop rotates.

* * * * *